US006210499B1

(12) United States Patent
Ebner et al.

(10) Patent No.: US 6,210,499 B1
(45) Date of Patent: Apr. 3, 2001

(54) METHOD OF BRIGHT ANNEALING METALS HAVING A HIGH AFFINITY TO OXYGEN

(76) Inventors: Peter Ebner, Bergham 168; Heribert Lochner, Burgwallstrasse 19, both of A-4060 Leonding (AT)

( * ) Notice: Subject to any disclaimer, the term of this patent is extended or adjusted under 35 U.S.C. 154(b) by 0 days.

(21) Appl. No.: 09/410,622

(22) Filed: Oct. 1, 1999

(30) Foreign Application Priority Data

Oct. 5, 1998 (AU) ..... A 1662/98

(51) Int. Cl.[7] ..... C21D 1/26

(52) U.S. Cl. ..... 148/559; 148/579; 148/633; 148/668; 148/669

(58) Field of Search ..... 148/559, 579, 148/668, 669, 633

(56) References Cited

U.S. PATENT DOCUMENTS 4,369,078 * 1/1983 Aslund ..... 148/126
4,813,654 * 3/1989 Singler ..... 266/262
5,284,526 * 2/1994 Garg et al. ..... 148/208
5,362,031 * 11/1994 Heilmann et al. ..... 266/89
5,685,088 * 11/1997 Nakamura ..... 34/242
5,772,428 * 6/1998 Van Den Sype et al. ..... 432/23
5,785,774 * 7/1998 Van Den Sype et al. ..... 148/634

* cited by examiner

*Primary Examiner*—Roy V. King
*Assistant Examiner*—Nicole Coy
(74) *Attorney, Agent, or Firm*—Collard & Roe, PC

(57) ABSTRACT

To be able to satisfactorily bright-anneal metals having a high affinity to oxygen in a hood-type furnace or the like under a protective gas, a rather pure inert gas such as argon, neon or helium, which is mixed with not more than 50 vol-% of a reducing gas, for instance hydrogen, is used as protective gas in cooperation with an oxygen binder, preferably titanium.

7 Claims, No Drawings

METHOD OF BRIGHT ANNEALING METALS HAVING A HIGH AFFINITY TO OXYGEN

FIELD OF THE INVENTION

This invention relates to a method of bright annealing metals having a high affinity to oxygen in a hood-type furnace or the like under a protective gas.

DESCRIPTION OF THE PRIOR ART

Medium- to high-alloy steels, non-ferrous metals and metals which in general are difficult to bright-anneal and have components with a high affinity to oxygen, e.g. chromium, manganese, silicon, titanium etc., have so far been subjected to a heat treatment, in order to mold their structure or recrystallize their microstructure after the molding steps. This is usually done in hood-type furnaces with non-enclosed understructure, where hydrogen or a mixture of hydrogen and nitrogen is used as protective gas. Due to the contact with the isolation of the understructure in the furnace oxygen residues are, however, transported by the hydrogen to the batch to be treated, e.g. to strip coils. The hydrogen resulting from the reaction will then oxidize the surface of the material to be annealed, where a further deficiency results from the fact that oxygen residues in the protective gas react with the surface of the material to be annealed.

When a hood-type furnace with an enclosed understructure is used, annealing may be performed under lowest dew points, but visible, disturbing oxidation residues may still remain at the metal surface of the material to be annealed.

Finally, the pure, extremely reducing hydrogen may reducingly attack the oxides of the annealing box, i.e. for instance of the heat-resistant steel construction of the understructure, the protective hood, the understructure fan, arid the distributor as well as existing scale, and transport the resulting moisture to the material to be annealed. By packing the material to be annealed in films, for instance, or by covering it with caps of steel that is free from elements having a high affinity to oxygen, a residual discoloration of the material to be annealed can not completely be repressed either.

In addition, lubricant residues from the preceding molding operations may still be present on the surface of the material to be annealed, which lubricant residues chiefly consist of water and oil, i.e. an emulsion, and evaporate during heating and react with the surface of the material to be annealed. Even by supplying a large amount of protective gas, residual discolorations can therefore not be avoided.

SUMMARY OF THE INVENTION

It is therefore the object underlying the invention to provide a method as described above, where surface defects of the material to be annealed are virtually eliminated.

This object is solved by the invention in that a rather pure inert gas such as argon, neon or helium is used as protective gas in cooperation with an oxygen binder, preferably titanium.

By using such protective gas together with an oxygen binder provided in the interior of the annealing box, reactions of oxygen carriers such as CO, $CO_2$, $H_2O$ or oxygen, which involve an oxidation or discoloration of the material to be annealed, are prevented. In addition, the transport of oxygen and oxygen carriers from the heat-resistant material of the annealing box to the material to be annealed is prevented at all.

The use of nitrogen as inert gas is possible only to a restricted extent, as an undesired formation of nitride at the surface of the material to be annealed might occur with various metals.

If metals contaminated with residual amounts of lubricant should be subjected to bright annealing, the lubricant is first of all evaporated under a protective gas which includes a noble or inert gas such as nitrogen, and/or a reducing gas such as hydrogen, and for the subsequent bright annealing the rather pure inert gas, which is mixed with not more than 50 vol-% of a reducing gas, is then used as protective gas in cooperation with an oxygen binder, preferably titanium.

The process of evaporating the residual lubricant adhering to the surface may be performed under a different protective gas or protective gas mixture than the process of bright annealing, as the evaporation takes place at low temperatures, so that no disturbing surface discolorations need to be expected. After the evaporation, the heat treatment is continued by exchanging the protective gas.

What is claimed is:

1. A method of bright annealing a metal having a high affinity to oxygen under a protective hood in an atmosphere comprised of a protective gas consisting of a substantially pure inert gas in the presence of an oxygen binder.

2. The bright annealing method of claim 1, wherein the inert gas is argon, neon or helium.

3. The bright annealing method of claim 1, wherein the oxygen binder is titanium.

4. The bright annealing method of claim 1, wherein the metal is contaminated with a residual lubricant, comprising the steps of first evaporating the residual lubricant under a protective gas and then bright annealing the metal in the atmosphere comprised of the protective gas consisting of the substantially pure inert gas mixed with no more than 50%, by volume, of a reducing gas and the oxygen binder.

5. The bright annealing method of claim 4, wherein the protective gas under which the residual lubricant is evaporated is comprised of an inert gas, a reducing gas or a mixture thereof.

6. The bright annealing method of claim 5, wherein the inert gas is nitrogen.

7. The bright annealing method of claim 5, wherein the reducing gas is hydrogen.

* * * * *

UNITED STATES PATENT AND TRADEMARK OFFICE

CERTIFICATE OF CORRECTION

PATENT NO. : 6,210,499 B1
DATED : April 3, 2001
INVENTOR(S) : Peter Ebner et al.

It is certified that error appears in the above-identified patent and that said Letters Patent is hereby corrected as shown below:

Title page,
Item [30], please change to:
-- Oct. 5, 1998 [AT] ..... A 1662/98 --

Signed and Sealed this

Twenty-sixth Day of March, 2002

*Attest:*

*Attesting Officer*

JAMES E. ROGAN
*Director of the United States Patent and Trademark Office*